US005673532A

United States Patent [19]

Jennings et al.

[11] Patent Number: 5,673,532

[45] Date of Patent: Oct. 7, 1997

[54] COATING OF SURFACES

[75] Inventors: Howard Timothy Jennings; Nicola McKeown, both of Cheshire, United Kingdom

[73] Assignee: British Nuclear Fuels plc, United Kingdom

[21] Appl. No.: 530,382

[22] PCT Filed: Feb. 9, 1995

[86] PCT No.: PCT/GB95/00256

§ 371 Date: Oct. 10, 1995

§ 102(e) Date: Oct. 10, 1995

[87] PCT Pub. No.: WO95/22149

PCT Pub. Date: Aug. 17, 1995

[30] Foreign Application Priority Data

Feb. 10, 1994 [GB] United Kingdom ..... 9402597

[51] Int. Cl.[6] ..... E04F 13/14

[52] U.S. Cl. ..... 52/742.16; 52/741.4; 52/390

[58] Field of Search ..... 52/742.16, 311.2, 52/390, 741.4

[56] References Cited

U.S. PATENT DOCUMENTS

| | | | |
|---|---|---|---|
| 4,817,963 | 4/1989 | Munden et al. | 52/742.16 X |
| 4,990,398 | 2/1991 | Fukumoto et al. . | |
| 5,186,217 | 2/1993 | Kallinich et al. . | |

FOREIGN PATENT DOCUMENTS

| | | |
|---|---|---|
| 2 482 761 | 11/1981 | France . |
| 1 330 298 | 9/1973 | United Kingdom . |
| WO 93/13531 | 7/1993 | WIPO . |

*Primary Examiner*—Christopher Todd Kent
*Attorney, Agent, or Firm*—Nixon & Vanderhye

[57] ABSTRACT

A wall or other surface is coated by applying a multiplicity of tiles to adhere to the surface, the edges between adjacent tiles being separated by grouting materila comprising a vitrifiable particulate material incorporated in a binder, and applying local heat from a source of heat to the grouting material to cause vitrification of the particulate material thereby to weld the tiles together.

17 Claims, 1 Drawing Sheet

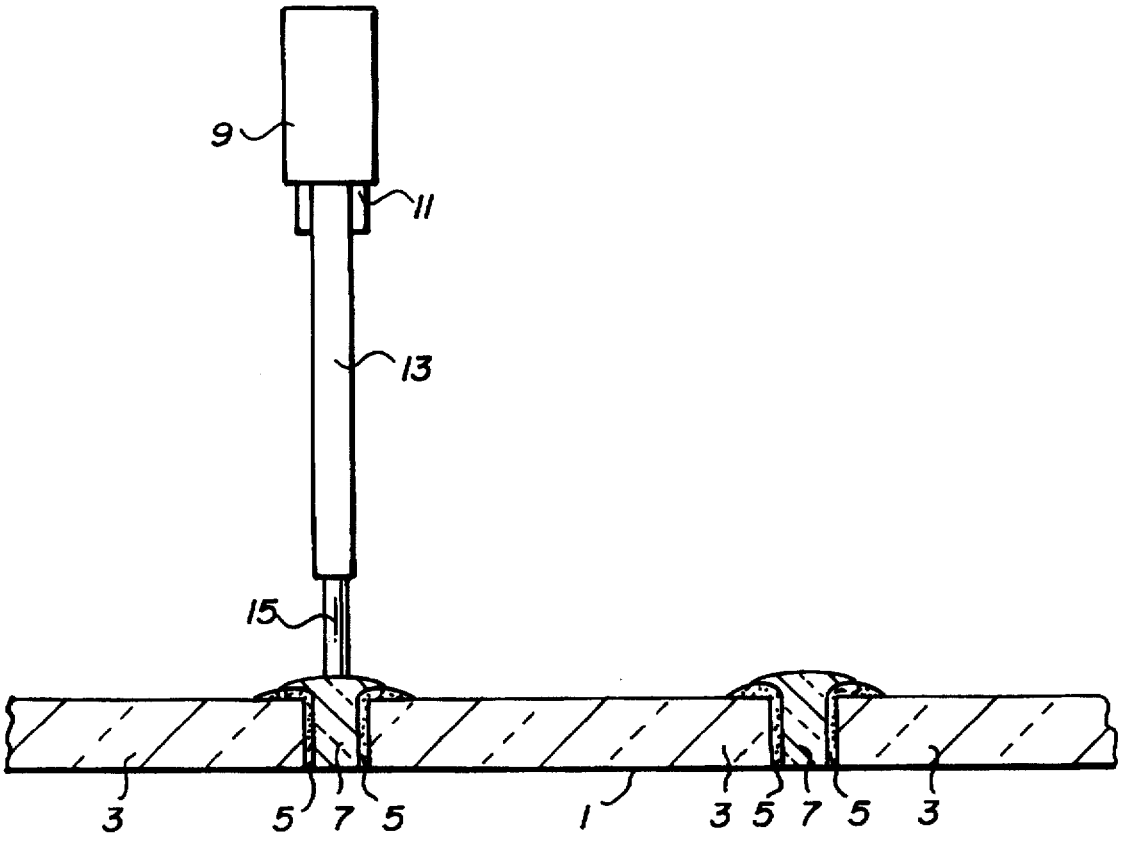
9
11
13
15
3
5
7
5
1
3
5
7
5
3

COATING OF SURFACES

The present invention relates to the coating of surfaces, especially large area surfaces of containments such as tanks, containers, vessels, cabins, rooms and the like.

BACKGROUND OF THE INVENTION

In our prior specification WO 93/13531 a convenient method of immobilising and sealing radioactive contaminants contained on a contaminated surface is described. A source of intense heat is applied to effect the immobilisation and sealing. In one embodiment, a vitrifiable powder may be applied to the surface being treated. The heat, eg provided by a laser beam, causes a suitable glazed coating to be formed from the vitrifiable material to cause the contaminants to be immobilised and sealed.

The method described in the said prior specification is aimed specifically at the treatment of radioactively contaminated surfaces and is not intended for use in covering large area surfaces.

The purpose of the present invention is to provide a method of coating a surface, especially a large area surface, to protect the surface from corrosive agents which may or may not include agents other than radioactive contaminants.

According to the present invention there is provided a method of forming a coating on a wall or other surface of an object which comprises the steps of applying a multiplicity of tiles to adhere to the surface, the edges between adjacent tiles being separated by grouting material comprising a vitrifiable particulate material incorporated in a binder, and applying local heat from a source of heat to the routing material to cause vitrification of the particulate material thereby to weld the tiles together.

The said surface may be the wall, ceiling or floor of a containment such as a tank, vessel, container, cabin, room or the like.

The said tiles may be plates or blocks having main faces which are bounded by shapes which fit closely together, eg straight sided quadrilateral shapes, for example squares, rectangles, diamonds or parallelograms.

The said tiles could alternatively have other shapes which fit together without substantial gaps, eg triangles or hexagons.

The said tiles may be made of glass-ceramic material which may itself include at least regions of a vitrifiable material which assists welding together of adjacent tiles by vitrification of the grouting material.

The tiles may be adhered to the underlying surface by conventional adhesive, eg a resinous material and/or by the weld formed by heat treatment of the vitrifiable material between tiles or at convenient points through the tiles creating a 'pinning' action. In the latter case, the tiles may be provided with one or more pre-formed holes to facilitate irradiation of the underlying surface from the source of heat.

The said vitrifiable material may comprise glass powder optionally mixed with one or more other particulate materials comprising metal, ceramic, stone such as granite, pozzolana, pozzolan or chamotte.

The binder may comprise a material providing a paste or a spray, eg an aqueous or organic liquid, whereby the material may be applied by spraying, pasting or other suitable application process.

The said material may optionally include a colouring agent.

The applied heat may provide an energy level of at least 50 watts per $cm^2$, preferably at least 150 Watts per $cm^2$, at the surface being treated. The heat may be provided by laser radiation which may be obtained from a laser source applied directly or via an optical coupling means, eg a fibre optic guide. Suitable laser radiation may be provided by a solid state, eg a rare earth doped crystal laser, such as Nd/YAG (neodymium/yttrium aluminium garnet), or a gas laser such as a helium/neon or carbon dioxide laser. The radiation from such a laser source may be in the visible or other (eg infra red) region of the electromagnetic spectrum. The output radiation from the laser source may be continuous or pulsed. The radiation may be formed in a spot, eg having a diameter of from 4 mm to 8 mm.

Where the heat is provided by laser radiation, the laser radiation may be swept along the regions to be vitrified on the surface to be treated. The sweeping may be achieved by moving the laser source, by deflecting a beam provided by a fixed laser source or by moving across the surface a guide means, eg fibre optic cable, conducting the laser radiation. These movements may be carried out by a human operator or by an automatic handling robotic device.

The heat could be applied by another suitable source hot enough to vitrify the vitrifiable material, eg a tungsten pin or light from an arc lamp coupled to a suitable optical system.

The action of the heat in the method according to the present invention is to fix a region of material between tiles thereby welding tiles together and to the underlying surface.

The present invention provides a convenient method of forming an impervious glazed coating over a surface to be covered. Such a coating can be a continuous glazed surface and may be sufficiently protective to prevent chemical and microbial degradation of the underlying surface. Microbial degradation of the surface can be further prevented by incorporating in the vitrifiable material, agents which actively discourage the growth of micro-organisms.

In general, the area of vitrifiable material fixed by the action of heat can be much less than the underlying surface area being covered by the tiles. Thus, it is only necessary to apply heat over a fraction of the surface area to be covered rather than over the whole area as applied for example in the method described in WO 93/13531.

The tiles employed in the method according to the present invention may conveniently be of a glass-ceramic material and may comprise conventional tiles as employed for domestic wall covering applications.

The coating of glassy material formed by heat treatment of the vitrifiable material may be similar or the same as the glass-ceramic material of the tiles.

Alternatively, where the coating of glassy material formed by heat treatment of the vitrifiable material is not the same as the material of the tiles and the two materials have different thermal expansion properties an intermediate material, eg an edging material, may be applied to the edges of tiles between which vitrifiable grouting material is applied.

The intermediate material may have thermal expansion properties which are intermediate those of the material of the tiles and the glassy material formed by heat treatment of the vitrifiable material.

The present invention is particularly useful to coat large area walls, floors, ceilings and the like, eg of large surface area concrete tanks and other containers. It may also be employed to coat other surface requiring protective coatings.

The present invention may be employed to coat protectively surfaces such as the walls, ceilings or floors of containments in which biologically or chemically corrosive agents are present need to be prevented from attacking the underlying structure and may need to be easily removed, eg by conventional wiping and cleaning of the coating. For example, the present invention may be employed to coat surfaces inside sewage treatment tanks, bioprocessing reactors, chemical storage vessels, clean rooms, pathology laboratories, food processing plants or in any other environment in which large surface areas are desired to be provided with protective coatings and wherein it is impractical to transport a single body of surface area coating material to the site of use to cover the entire surface to be coated.

SUMMARY OF THE INVENTION

An embodiment of the present invention will now be described by way of example with reference to the accompanying drawing in which:

BRIEF DESCRIPTION OF THE DRAWINGS

FIG. 1 is a cross-sectional side elevation of a surface being protectively coated.

DETAILED DESCRIPTION OF THE INVENTION

In FIG. 1 a protective coating is being formed on a surface 1. Glass ceramic tiles 3 are deposited on the surface 1. The tiles 3 have vitrifiable edging layers 5 at their adjacent edge. Vitrifiable powdered material 7 contained in a binder is deposited to fill the gaps between edges of the tiles 3 and covers the edging layer 5 at least where the edging material is formed between edges of the tiles 3. A laser source 9 has an optical output coupled by a coupling unit 11 into a fibre optic guide 13. A beam 15 of laser radiation is thereby formed and may be directed along the regions of the powdered material 7.

The powdered material 7 has thermal expansion properties which are intermediate those of the glass-ceramic material of the tiles 3 and the edging layers 5. The heat provided by the laser beam 15 causes melting of the powdered material 7 and of the material of the edging layers 5 and thereby vitrifies and (after removal of the beam 15) fuses these materials together and to the outer surface of the tiles 3 and to the surface 1.

Although the material 7 is shown in FIG. 1 in exaggerated form to extend significantly above the outer surfaces of the tiles 3 in practice the joints formed between adjacent tiles 3 by the edging layers 5 and the vitrifiable material 7 may give the appearance of a substantially flat surface. In any event, the effect of welding the tiles 3 together in this way is to form a continuous glazed outer surface which is resistant to attack by chemical and microbiological corrosive agents and thereby protects the underlying surface 1.

We claim:

1. A method of forming a coating on a surface of an object which comprises the steps of applying a multiplicity of tiles having edges to adhere to the surface, the edges between adjacent tiles being separated by a vitrifiable grouting material incorporated in a binder, and applying local heat from a source of heat to the vitrifiable grouting material to cause vitrification of the vitrifiable grouting material thereby to weld the tiles together.

2. The method as in claim 1 wherein the surface is a wall, ceiling or floor of a containment vessel, container, cabin or room.

3. The method as in claim 1 where in the tiles are plates having main faces which are bounded by shapes which fit closely together.

4. method as in claim 1 wherein the files are made of glass-ceramic material which includes at least regions of a vitrifiable material which assists welding together of adjacent tiles by vitrification of the vitrifiable grouting material.

5. The method as in claim 1 wherein the files are adhered to the surface by a weld formed by heat treatment of the vitrifiable grouting material between tiles at convenient points through the tiles.

6. The method as in claim 1 wherein the tiles are adhered to the surface by a resinous material.

7. The method as in claim 1 wherein the tiles are adhered to the surface by a resinous material and by a weld formed by heat treatment of the vitrifiable grouting material between tiles at convenient points through the tiles.

8. The method as in claim 1 wherein the vitrifiable grouting material is a glass powder.

9. The method as in claim 8 wherein the glass powder also contains another particulate material selected from metal, ceramic, stone, pozzolana, pozzolan and chamotte.

10. The method as in claim 1 wherein the vitrifiable grouting material is applied by spraying.

11. The method as in claim 1 wherein the vitrifiable grouting material is applied by pasting.

12. The method as in claim 1 wherein the applied local heat provides an energy level of at least 50 watts per $cm^2$ at the surface being treated.

13. The method as in claim 12 wherein the source of heat is provided by laser radiation.

14. The method as in claim 13 wherein the radiation is formed in a spot having a diameter of from 4 mm to 8 mm at the surface being treated.

15. A method as in claim 1 wherein an intermediate material is applied between the tiles and the vitrifiable grouting material, the intermediate material having thermal expansion properties which are intermediate those of a material of the tiles and a material formed by heat treatment of the vitrifiable grouting material.

16. A method of forming an impervious glazed coating on a surface of an object, which method comprises the steps of (1) applying a multiplicity of glazed tiles to adhere to the surface, the glazed tiles having edges and spaced apart from each other defining spaces therebetween, each tile edge provided with a vitrifiable grouting material, the edges between adjacent tiles being separated by a vitrifiable grouting material incorporated in a binder, and (2) applying local heat from a source of heat to the vitrifiable grouting material to cause vitrification of the vitrifiable grouting material thereby to weld the tiles together.

17. The method as in claim 16 wherein the tiles are made of glass-ceramic material which includes at least regions of a vitrifiable material which assists welding together of adjacent tiles by vitrification of the grouting material.

* * * * *